US009587323B2

(12) United States Patent
Adkisson et al.

(10) Patent No.: US 9,587,323 B2
(45) Date of Patent: Mar. 7, 2017

(54) ELECTRODEPOSITION ELECTRODE FOR USE IN THE INTERIOR OF A PIPE

(71) Applicant: S & J TECHNOLOGIES, LLC, Seminole, OK (US)

(72) Inventors: Sammy Lee Adkisson, Seminole, OK (US); Samual Adam Adkisson, Seminole, OK (US); John Bougneit, Mission, TX (US); Dale Lee Hughes, Konowa, OK (US)

(73) Assignee: S & J Technologies, LLC, Seminole, OK (US)

( * ) Notice: Subject to any disclaimer, the term of this patent is extended or adjusted under 35 U.S.C. 154(b) by 0 days.

(21) Appl. No.: 14/977,243

(22) Filed: Dec. 21, 2015

(65) Prior Publication Data

US 2016/0108543 A1 Apr. 21, 2016

Related U.S. Application Data

(62) Division of application No. 14/184,218, filed on Feb. 19, 2014, now Pat. No. 9,255,340.

(51) Int. Cl.

| | |
|---|---|
| ***C25D 17/12*** | (2006.01) |
| ***C25D 13/22*** | (2006.01) |
| ***C25D 21/14*** | (2006.01) |
| ***C25D 13/14*** | (2006.01) |

(52) U.S. Cl.

CPC ..... *C25D 17/12* (2013.01); *C25D 13/14* (2013.01); *C25D 13/22* (2013.01); *C25D 21/14* (2013.01)

(58) Field of Classification Search

CPC ..... C25D 13/22; C25D 21/14; C25D 17/12; C25D 13/14; C25D 7/04; C25D 5/00; C25C 7/02

See application file for complete search history.

(56) References Cited

U.S. PATENT DOCUMENTS

| | | | | |
|---|---|---|---|---|
| 4,094,760 | A | 6/1978 | Smith et al. | |
| 4,851,102 | A | 7/1989 | Inoue | |
| 2010/0116651 | A1* | 5/2010 | Mizuno | C25D 17/12 204/286.1 |

FOREIGN PATENT DOCUMENTS

| | | | |
|---|---|---|---|
| FR | 2693129 | * | 7/1994 |

* cited by examiner

*Primary Examiner* — Xiuyu Tai

(74) *Attorney, Agent, or Firm* — McAfee & Taft A Professional Corporation

(57) ABSTRACT

A method is provided for electrodepositing a coating a conductive workpiece. The method provides for individually switching on or off electrodes both interior to and exterior to the workpiece so as to control the deposition of the coating material on the interior surface and the exterior surface of the workpiece. Further, an electrode having insulating positioners can be utilized to provide for better centering of the electrode in the interior of the workpiece.

8 Claims, 13 Drawing Sheets

ELECTRODEPOSITION ELECTRODE FOR USE IN THE INTERIOR OF A PIPE

CROSS-REFERENCE TO RELATED APPLICATIONS

This application claims the benefit of U.S. Provisional Application No. 61/767,103 filed Feb. 20, 2013, and is a divisional of U.S. patent application Ser. No. 14/184,218 filed Feb. 19, 2014, now allowed. Both of which are hereby incorporated by reference.

FIELD OF THE INVENTION

This invention relates generally to electrophoretic deposition of materials on workpieces and more specifically to the distribution of current in processes for the electrophoretic deposition of materials onto workpieces.

BACKGROUND

Electrophoretic deposition, also known as electrodeposition or electrocoating, is predicated upon the phenomenon that charged particles suspended in a liquid medium migrate under the influence of an electric field and are deposited onto an electrode. Electrophoretic deposition of particulate materials to form coatings is currently used in a wide variety of industrial applications, such as in the manufacture of enameled ironware, in applying paint and rubber coatings to metal and plastic articles, in the formation of dielectric coatings on electrical devices, and in other similar industrial processes. Electrophoretic deposition has many advantages over other conventional methods of applying coatings, such as spraying, dipping, brushing and the like, in that the coating is deposited more effectively with regard to the full utilization of the material in the suspension, as there is substantially no waste of particulate materials; and the electrophoretically applied coating is generally more uniform in thickness and density. Unfortunately, the uniformity of the deposition of material across the workpiece can depend on a number of factors, including shape of the workpiece, number of electrodes utilized, location of the electrodes, and such. Additionally, underperformance of one electrode or group of electrodes, i.e. failing to provide a similarly strong current as the other electrodes, can create variations in thickness. Accordingly, there is an interest in finding new ways of controlling the deposition of materials to different parts of the workpiece in order to obtain a more uniform coating.

SUMMARY OF THE INVENTION

In accordance with one embodiment of the invention there is provided a method of coating a conductive workpiece having an interior comprising an interior surface and an exterior comprising an exterior surface; the method comprising:

(a) positioning the workpiece in a mixture containing a coating material;
(b) positioning in the mixture and exterior to the workpiece an exterior electrode connected to a switching system;
(c) positioning in the mixture and interior to the workpiece an interior electrode connected to a switching system;
(d) applying a first potential between the workpiece and the exterior electrode to cause the coating material to deposit on the exterior surface of the workpiece;

(e) applying a second potential between the workpiece and the interior electrode to cause the coating material to deposit on the interior surface of the workpiece; and
(f) individually switching on or off the interior electrode and the exterior electrode so as to control the deposition of the coating material on the interior surface and the exterior surface.

In accordance with another embodiment of the invention there is provided a computer implemented method of controlling the coating of a workpiece with a coating material in an electrodeposition process comprising:

(a) accessing a recipe for the coating of the workpiece;
(b) controlling the coating of the workpiece in accordance with the predetermined recipe by switching on or off the current to a set of electrodes through a switching system providing individual switching of each of the electrodes and by controlling the current and voltage output of a rectifier supplying power to the electrodes;
(c) sampling current flow within the electrodeposition process and switching on or off a portion of the electrodes to compensate for non-linear coating deposition rates; and
(d) terminating the electrodeposition process based on predetermined criteria.

The recipe of the above method can be predetermined for a predetermined workpiece size and workpiece shape. Additionally, the method can comprise detecting variations in the size of the workpiece from the workpiece size of the recipe, and modifying the control of the output of the rectifier based on detecting variations in the size of the workpiece. Also, the method can comprise monitoring usage of the coating material and supplying additional coating material in accordance with amp hour usage.

In accordance with another embodiment of the invention there is provided an electrode for use in the interior of a pipe to be coated with a coating material in an electrodeposition process. The electrode comprising a conductive member having a length and a plurality of insulating positioners connected to the conductive member. The insulating positioners are spaced along the length of the conductive member. The breadth of each insulating positioner is perpendicular to the length of the member and is approximately equal to the internal diameter of the pipe.

BRIEF DESCRIPTION OF THE DRAWINGS

FIG. 6 is a flow chart illustrating in greater detail the primary hardware control function of the embodiment illustrated in FIG. 5.

FIG. 9 is a flow chart illustrating in greater detail the ancillary functions of the embodiment illustrated in FIG. 5

DESCRIPTION OF THE SELECTED EMBODIMENTS

Figure 1:
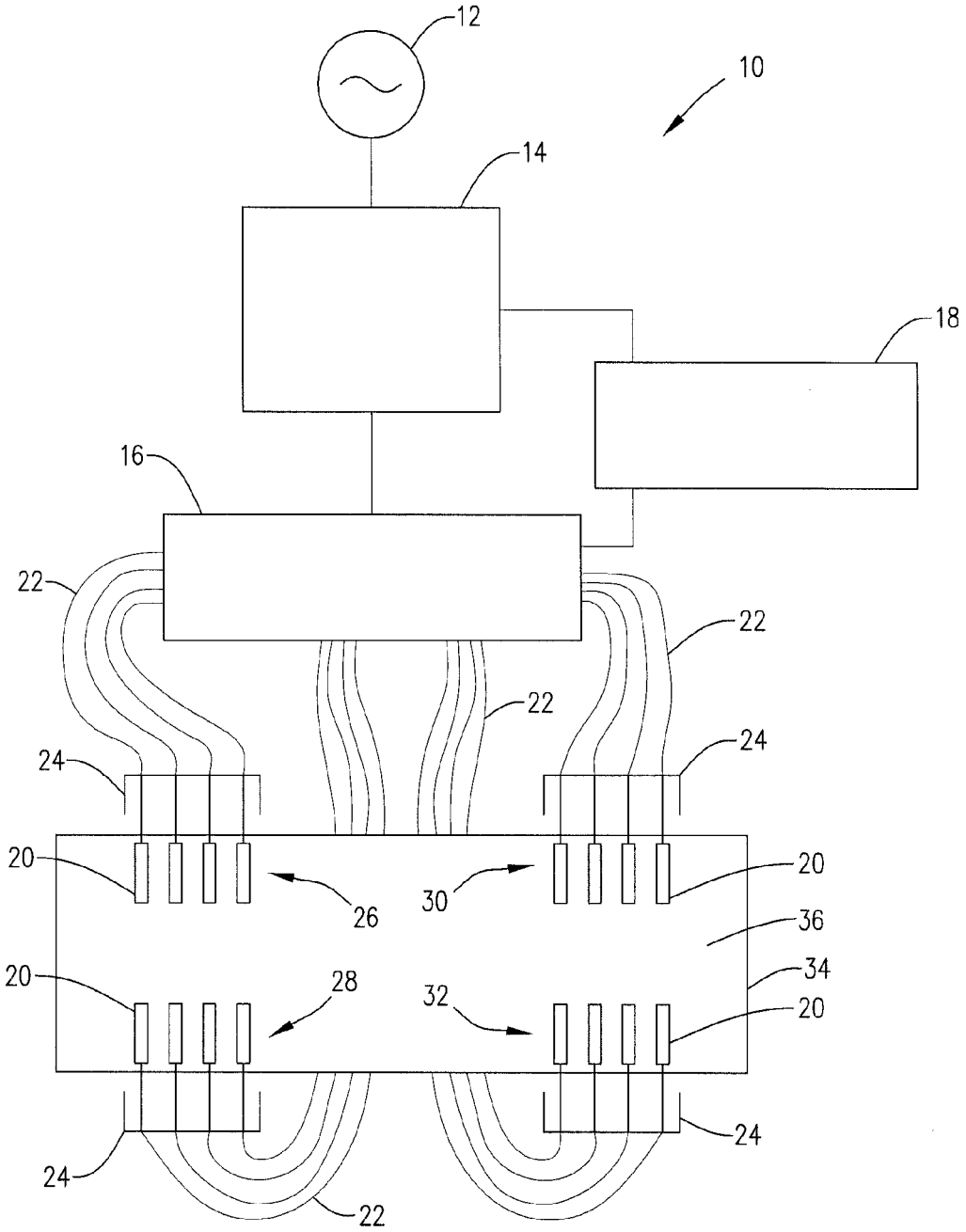
FIG. 1 is a schematic drawing illustrating one embodiment of an anode distribution system in accordance with the current invention.

The method in accordance with the current invention is directed towards better and more efficient operations of electrophoretic deposition processes, also known as electrodeposition or electrocoating processes. Generally, the types of electrodeposition processes are ones where a coating material is deposited on a workpiece. Typically, the electrodeposition process involves submerging the part into a container or vessel, which holds the coating bath, and applying direct current electricity through the bath using electrodes. While, it is within the scope of the invention to use alternative paint contacting methods such as a stream, curtain or spray of paint, the invention will be described in terms of a coating bath.

The coating bath is a mixture comprising a solution or colloidal suspension of the coating material in water or another solvent, which may contain additives to facilitate conductivity of the solvent and/or promote the formation of the solution or colloidal suspension. Herein the term solvent is used for both a solvent, when there is a solution of the coating material or particles, and for the dispersion medium, when the coating material or particles are in a colloidal suspension. The coating particles need to be ions or molecules with ionizable groups. The process can be anodic or cathodic. In anodic, a negatively charged coating material is deposited on the positively charged electrode or the anode, i.e. the workpiece. In cathodic, a positively charged coating material is deposited on the negatively charged electrode or the cathode, i.e. the workpiece. For convenience, the below description will be described as a cathodic process to refer to a specific electrical flow, but the inventive method is applicable to either anodic or cathodic processes.

In the cathodic process, the workpiece is the negatively charged electrode or cathode. At least one positively charged electrode, or anode, is positioned in the coating bath. More typically, there will be two or more anodes positioned within the bath so as to at least partially surround or totally surround the workpiece. By introducing multiple anodes around the workpiece, a more even coating is obtained. When the direct electrical current is applied to the anodes; thus, establishing a potential difference between the anodes and workpiece such that the positively charged coating material will migrate by the process of electrophoresis towards the workpiece and be deposited thereon.

The coating material can be a metal, epoxy resin, or other suitable element or compound. The general requirement for the coating material being that it is ionizable or be a compound with ionizable groups so that an ionized solution can be prepared with the coating material.

The workpiece will generally be a conductive workpiece; that is, a workpiece made of a conductive material, such as one or more of metals, metal alloys, or graphite. Examples of suitable metals are carbon steel, stainless steel, aluminum, nickel, and copper, which all coat especially well. If the workpiece is made of new material, it may have protective coatings or other treatments that need to be removed prior to the electrodeposition. Generally, such coatings or treatments can be removed by the use of an alkaline bath. If the workpiece is made of used material or is an old workpiece then an abrasion cleaning can be used to remove scale, rust and other oxidation. Additionally, an alkaline bath can be used to remove oil, grease or other deposits.

As mention above, in a typical electrodeposition process multiple anodes are positioned around the workpiece. Generally, the coating material will be deposited first and most heavily on the portion of the workpiece surface closest to an anode. Utilizing multiple anodes ensures a more even distribution of coating material across the surface of the workpiece. In the past such anodes have been wired either in series or parallel. In more complicated arrangements, two or more groups or sets of anodes have been wired in parallel and the individual anodes of each set have been wired either in parallel or series with the other members of the set. Unfortunately, such past anodes configurations were subject to maldistribution of coating material when an anode failed to work. Where the anodes are wired in series, one anode failing to work could cause all or a set of anodes to fail to work and, thus, cause even greater maldistribution of coating material or even for some portions of the workpiece to have no coating material deposited on it at all. Additionally, when one or more anode fails to work the current is redistributed over the remaining anodes when they are wired in parallel; the voltage is redistributed over the remaining anodes when they are wired in series. This redistribution can result in even further maldistribution of coating material across the workpiece and in some cases, can overload the remaining anodes causing short-outs and further anode failure.

Turning now to FIG. 1, a schematic drawing illustrating the anode distribution system of the current invention is illustrated. Anode distribution system 10 has a power source 12 which supplies alternating current to rectifier 14. Rectifier 14 receives the alternating current and provides a direct current at the appropriate voltage and amperage to distribution system 16. Rectifier 14 and distribution system 16 are controlled by process control unit 18, as further described below. Distribution system 16 is a switching and distribution system; thus, it not only provides the direct current to each anode but also can switch each anode between an on-mode, where current flows to the anode, to an off-mode where no current flows to the anode. More precisely, the on-mode can be any frequency of current supplied to the anode where the on time (or time in which current is supplied) is 50% or more of the duty cycle up to 100% of the duty cycle. Conversely, the off-mode is any frequency of current supplied to the anode where the off time (or time in which current is not supplied) is more than 50% of the duty cycle up to 100% of the duty cycle. The duty cycle is the amount of time that an anode is in an on-mode or off-mode and depends upon the object to be coated and the amount of coating desired on each portion of the object. The duty cycle can be from on the order of nanoseconds or milliseconds to on the order of hours.

The switching function can be performed by an electronic switch suitable for use in medium- to high-power applications. One suitable switch is an insulated-gate bipolar transistor (IGBT), which is a three-terminal power semiconductor device combining high efficiency and fast switching. The IGBT is well-suited for use in the invention partly because of its reverse current blocking capabilities; that is, it does not allow flow of the current from the anode back to the distribution system.

The distribution system is connected to anodes 20 by wires 22, which as shown connect to anodes 20 through connectors 24. The anodes are positioned in the coating bath 36 contained in tank 34. In the illustrated embodiment, anodes 20 are collected into four sets or groups 26, 28, 30 and 32 of four anodes each; however, other arrangements are within the scope of the invention. Generally, the distribution system and anodes are connected so that each anode is connected through a switch so that each anode can be switched between the on-mode and off-mode independently from the other anodes. Accordingly, the anodes are wired in parallel. It is within the scope of the invention that two or more anodes will be controlled by a single switch; however, such grouping of the anodes will lessen the control over the current distribution through tank 34 and, thus, is more susceptible to maldistribution of the covering material over the surface of the workpiece.

Figure 2:
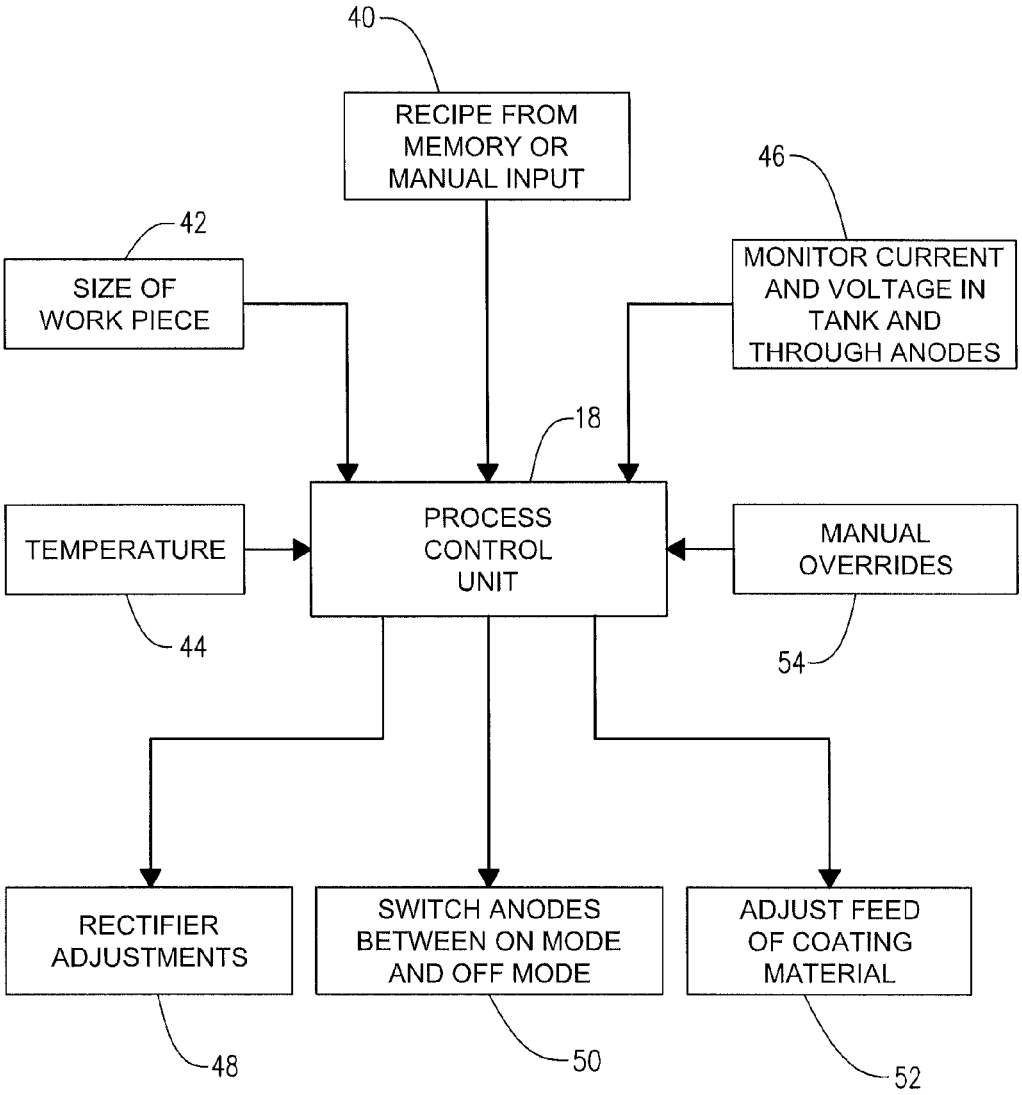
FIG. 2 is a block diagram of the interaction of the process control unit with an electrodeposition system in accordance with an embodiment of the current invention.

Turning now to FIG. 2, a block diagram of the interaction of the process control unit 18 with the electrodeposition system in accordance with an embodiment of the current invention is illustrated. Process control unit 18 may be any suitable programmable device configured to carry out the embodiments of the invention. Thus, process control unit 18 can be a controller or a plurality of controllers configured with a control algorithm, which when executed, performs the switching and other process controls or other functions, as described further below. Additionally, process control unit 18 can be one or more of a personal computer, portable computer, PC-based server, minicomputer, mid-range computer, mainframe computer or another computer capable of running the appropriate control algorithm to perform the switching, other process controls and other functions as described further below. Process control unit 18 is programmed with the control algorithm as further described below. As illustrated in FIG. 2, process control unit 18 receives inputs 40, 42, 44, 46 and 54 to provide information and data for the control algorithm to access the conditions at the start of and during the electrodeposition process.

At the start of the electrodeposition process, process control unit 18 can retrieve the relevant recipe for the coating of the applicable workpiece from memory or the recipe can be manually inputted (block 40). The recipe provides directions for controlling the electrodeposition process based on the type, shape and size of the workpiece and the type of coating material. As more fully explained below with reference to FIG. 7, the recipe includes the instructions for the control of the rectifier and anodes during the electrodeposition process. Additionally, process control unit 18 receives information on the size and shape of the workpiece (block 42). The size information can be manually inputted or can be detected by applying a small amount of voltage on a workpiece and reading the amperage draw, then comparing the result to a prepared linearized table. It is typical for a large non-coated part to require higher amps than a small non-coated part. At initiation and during the electrodeposition process, the process control unit can monitor the temperature (block 44) of the coating bath by use of any suitable device, such as a thermocouple. Also, at initiation and during the electrodeposition processes, the process control unit monitors the current flow through each anode and the voltage across the anode and can monitor the current and voltage at one or more locations in the coating bath by one or more electrical sensors (block 46). Based on the information received and the recipe, the process control unit adjusts rectifier (block 48), switches the anodes between the on-mode and off-mode (block 50) and adjusts the feed of new coating material into the coating bath (block 52). Finally, the system can receive instructions from the operator that manually overrides the instructions of the recipe or the control algorithm running on the process control unit (block 54).

Figure 3:
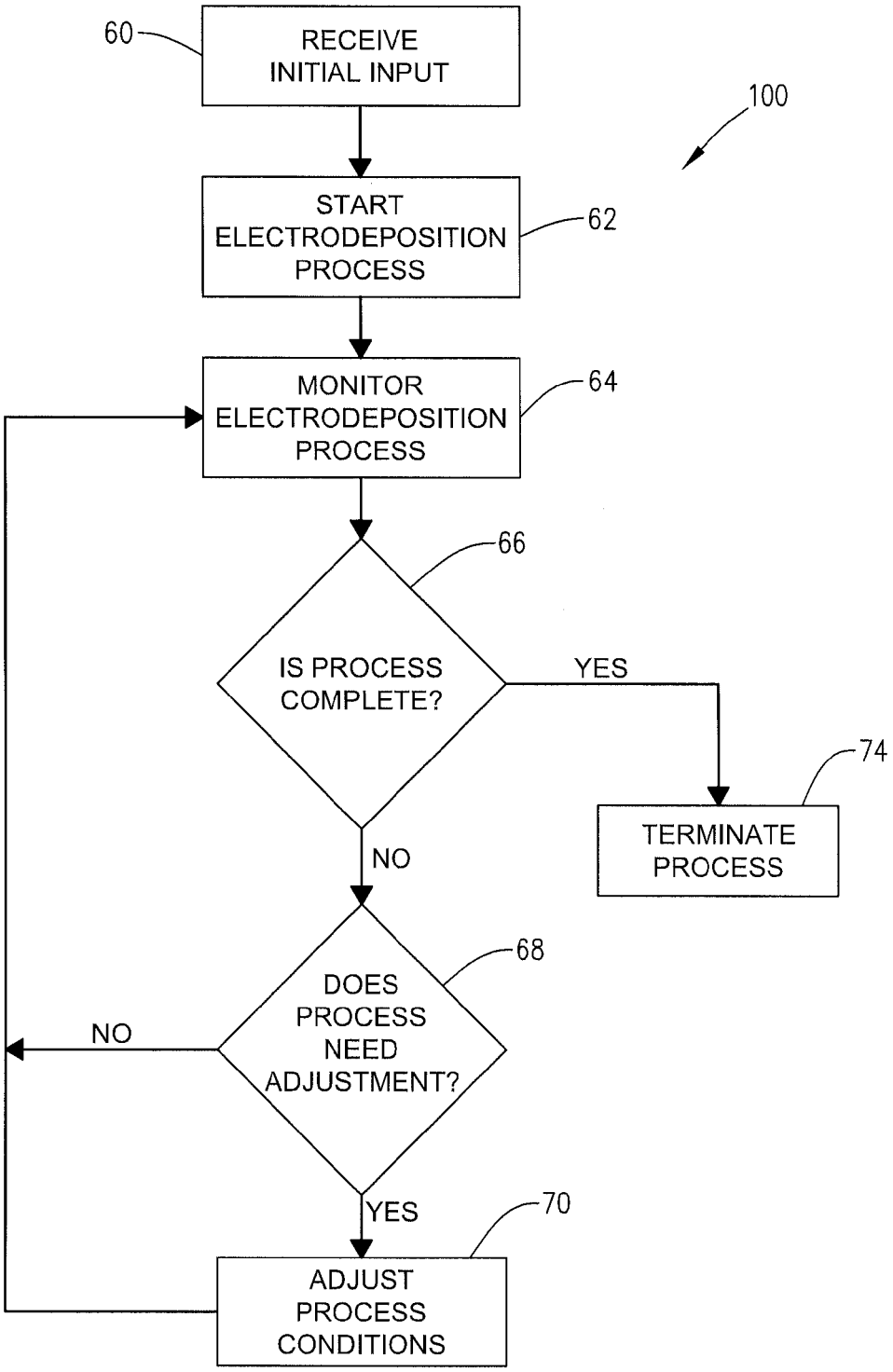
FIG. 3 is a flow chart illustrating the control of an electrodeposition process by a control algorithm in accordance with an embodiment of the current invention.

Turning now to FIG. 3, a flow chart illustrating the control of an electrodeposition process by the control algorithm 100 in accordance with an embodiment of the current invention is presented. In step 60, Control algorithm 100 receives the initial inputs; recipe, initial temperature of the coating bath, size of workpiece, etc. Based upon the initial inputs, control algorithm 100 starts up the electrodeposition process in step 62. This can include adjusting the rectifiers to compensate for the load size variation of the workpiece and determining if all or a portion of the anodes should be in the on-mode at the start of the process.

For example, if the workpiece is a pipe that needs to be coated on both the exterior and interior surfaces, the process can start with anodes located exterior to the pipe in the on-mode and the anodes in the interior of the pipe in the off-mode. After the exterior surface has received a suitable coating, the exterior anodes can be switched to the off-mode and the interior anodes can be switch to the on-mode to coat the interior surface. In the past, both surfaces have been coated at the same time, typically using only external electrodes, which has generally led to coating maldistribution with one surface receiving a thicker and more consistent coat than the other surface.

Additionally, if one or more of the anodes is not working, i.e. is not passing current or not passing sufficient current, one or more other anodes can be switch to the off-mode to balance the current across the workpiece. Referring to FIG. 4, this current balancing will be more fully explained. As can be seen by reference to FIG. 4, an advantage of the invention is superior current balancing when a portion of the anodes are in the off-mode and/or when a portion of the anodes are underperforming, that is not passing the designed amount of current.

Figure 4A:
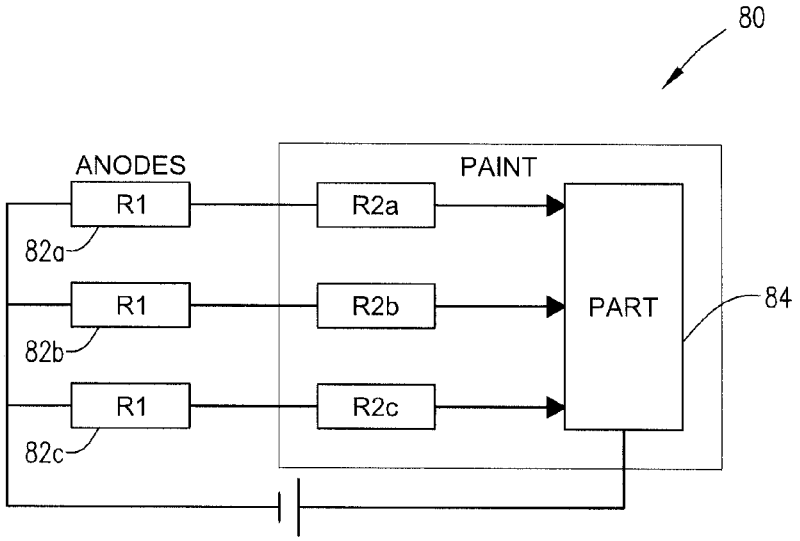
FIG. 4A PRIOR ART
FIG. 4*a* is a simplified diagram depicting the connections of anodes in a coating bath for a prior art electrodeposition system.

FIG. 4A shows a prior art electrodeposition system 80 for coating a part 84. The anodes 82*a*, 82*b* and 82*c* have a resistance R1, which is generally near zero because the anodes are conductors. The coating bath has a resistance R2*a*, R2*b* and R2*c*, collectively R2. Variations among the coating bath resistance R2 are due to distance variation of each anode 82 from workpiece 84 with increased distance resulting in increased resistance. According to ohm's law current and resistance are inversely proportional, thus, the greater the distance between an anode and the workpiece, the greater the resistance R2 and the smaller the current that flows from the anode to the workpiece. This results in undercoating where the anode is farther away from the workpiece and over-coating where the anode is nearer the workpiece. The traditional system has no way to correct for differences in resistance R2 among the anodes. Additionally, the anodes 82 are connected in parallel; thus, if one anode fails all the others take the load; that is, share an increase in current. At best, this causes over-coating in good anode areas and undercoating in failed anode areas; however, it can result in shorting out of the good anode areas.

Figure 4B:
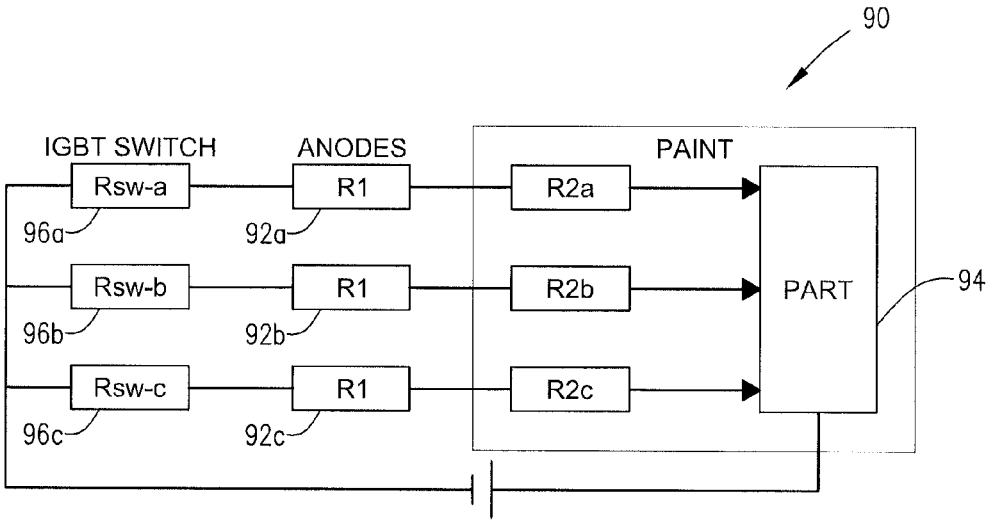
FIG. 4*b* is a simplified diagram depicting the connections of anodes in a coating bath for an embodiment of the current invention.

FIG. 4B shows an electrodeposition system 90 for coating a part 94 in accordance with the invention. The anodes 92*a*, 92*b* and 92*c* are connected in parallel and have a resistance R1, which is generally near zero because the anodes are conductors. Similar to the traditional system, the coating bath has a resistance R2*a*, R2*b* and R2*c*, collectively R2. The resistance R2 depends on the distance of each anode 92 from workpiece 94. The inventive system has switches 96*a*, 96*b* and 96*c* associated with anodes 92*a*, 92*b* and 92*c*, respectively. When the distribution switches are on they introduce a small resistance Rsw to each anode line. Additionally, switches 96 are diode switches that prevent the backflow of current. While not wishing to be bound by theory, it is believed that the switch resistance Rsw combined with this backflow prevention enhances the natural current balancing effect of the parallel anode connection because no anode can feedback through another anode to cause undesirable ion generation. In other words, if R1 does not vary and Rsw-a is shut off then the remaining Rsw-b and Rsw-c will vary in shunt voltage drop according to ohm's law; thereby reducing the voltage differential between workpiece part 94 and anodes 92*b* and 92*c*; and thereby reducing ion generation by reducing current. Additionally, any anode that may underperform will draw less current and by ohm's law will not have the higher Rsw voltage drop and thereby allow more current to develop. The off-mode provided by the switch along with the balancing effect creates a predictable and controlled rate of ion generation and therefore allows a desirable coating thickness variation control.

Returning now to FIG. 3, the initial rectifier and anode settings will be based on the recipe and current state of the anodes. In accordance with the above discussion, some anodes can be initially in the off-mode in accordance with the recipe and with the preferred order of activating the anodes, in order to achieve full coating of the workpiece. Additionally, other anodes may be initially in the off-mode in order to utilize the current balancing effect to compensate for underperforming anodes. After the electrodeposition process is started, the control algorithm monitors the process in step 64. The monitoring includes tracking where the process is in the recipe; monitoring time, amps and/or amp-hour of operation for each anode; tracking total time, total amps and/or total amp-hour of the process; monitoring anode performance; temperature of the coating bath and similar. Tracking where the process is in the recipe can be done by one or more criteria such as tracking by time, amps and/or amp-hour. If time is used, the amount of time each anode is in the on-mode and the amount of time the process is running is tracked to determined if adjustments need to be made to the process in accordance with the recipe in step 68. Tracking the process by time does not reflect irregularities in anode performance or anode location in relation to the workpiece. Irregularities in anode performance may affect the amount of current conducted through the anode and, hence, the amount of coating material deposited on the portion of the workpiece surface closest to that anode because anodes most directly affect the amount of coating material deposited on the portion of the workpiece surface closest to the anode. Similarly, the location of anodes can effect the amount of current conducted through them because anodes located farther from the surface of the workpiece will deposit less coating material on the surface because the amount of current passed between the anode and the workpiece will be less in accordance with ohm's law. Thus, while tracking by time, gives some estimate of the amount of coating that has occurred, it does not accurately reflect the actual coating of the workpiece with coating material in all circumstances. Similarly, tracking coating by amps does not accurately reflect the actual coating of the workpiece with coating material in all circumstances. Accordingly, it is preferred to track the process by amp-hour. Amp-hour or ampere-hour refers to a unit of electric charge and is the electric charge transferred by a steady current of one ampere for one hour. Since coating material deposited on a portion of the workpiece surface directly depends on the amount of charge transferred from the anodes to that portion of the workpiece surface, tracking amp-hour for each anode allows control algorithm 100 to track the use and coating of the workpiece with greater accuracy. Control algorithm 100 can use the total amp-hour for all the anodes to determine the total coating material used and the total coating material deposited on the workpiece. Control algorithm 100 can use the amp-hour value of an individual anode or a group anodes to track the thickness of the coating material deposited on the specific portions of the workpiece surface that is most affected by the individual anode or the group of anodes.

While monitoring step 64 is ongoing, control algorithm can check if the process is completed in accordance with step 66. Generally, this will be a check on whether the process has been completed in accordance with the recipe and can include a check on whether one or more predetermined criteria have been met such as checking whether threshold values for total amp-hours of electrodeposition has been met and whether threshold values for individual anodes or groups of anodes have been met. If the process is complete, the algorithm will go to step 74 and terminate the electrodeposition process. If the process is not complete, then algorithm 100 will determine whether the electrodeposition process needs adjustment in step 68.

In step 68, control algorithm 100 utilizes a number of electrodeposition process variables to see if adjustment is needed. If no adjustment is needed then algorithm 100 continues monitoring the variables in accordance with step 64. If adjustment is needed, then algorithm 100 proceeds to step 70 to adjust the conditions. Algorithm 100 uses such variables as coating bath temperature, process run time, amp-hours of operation for each anode, total amp-hours of operation for groups of anodes, total amp-hours of operation for all the anodes, and similar. Algorithm 100 can compare the current process conditions to the recipe to determine if anodes need to be changed between on-mode and off-mode. For example, in coating a pipe, the current process conditions of amp-hour for the external anodes might indicate that that the exterior surface coating is complete when compared to the recipe. Algorithm 100 would then turn the external anodes to the off-mode, the internal anodes to the on-mode and continue the process until the amp-hour threshold indicated by the recipe for the internal anodes is reached. Additionally, algorithm 100 can compare amp-hours completed for different pairs of electrodes to determine if the anodes are underperforming. If an underperformance is detected, adjustments can be made by changing other anodes between the on-mode and off-mode to adjust for the underperforming anode. Algorithm 100 can require any number of anodes to switch on and off many times at any frequency necessary during the process to maintain coating control. After adjustments are made, algorithm 100 continues monitoring the system and making adjustments in accordance with steps 64, 66 and 68 until step 66 indicates that the process is complete.

Figure 5:
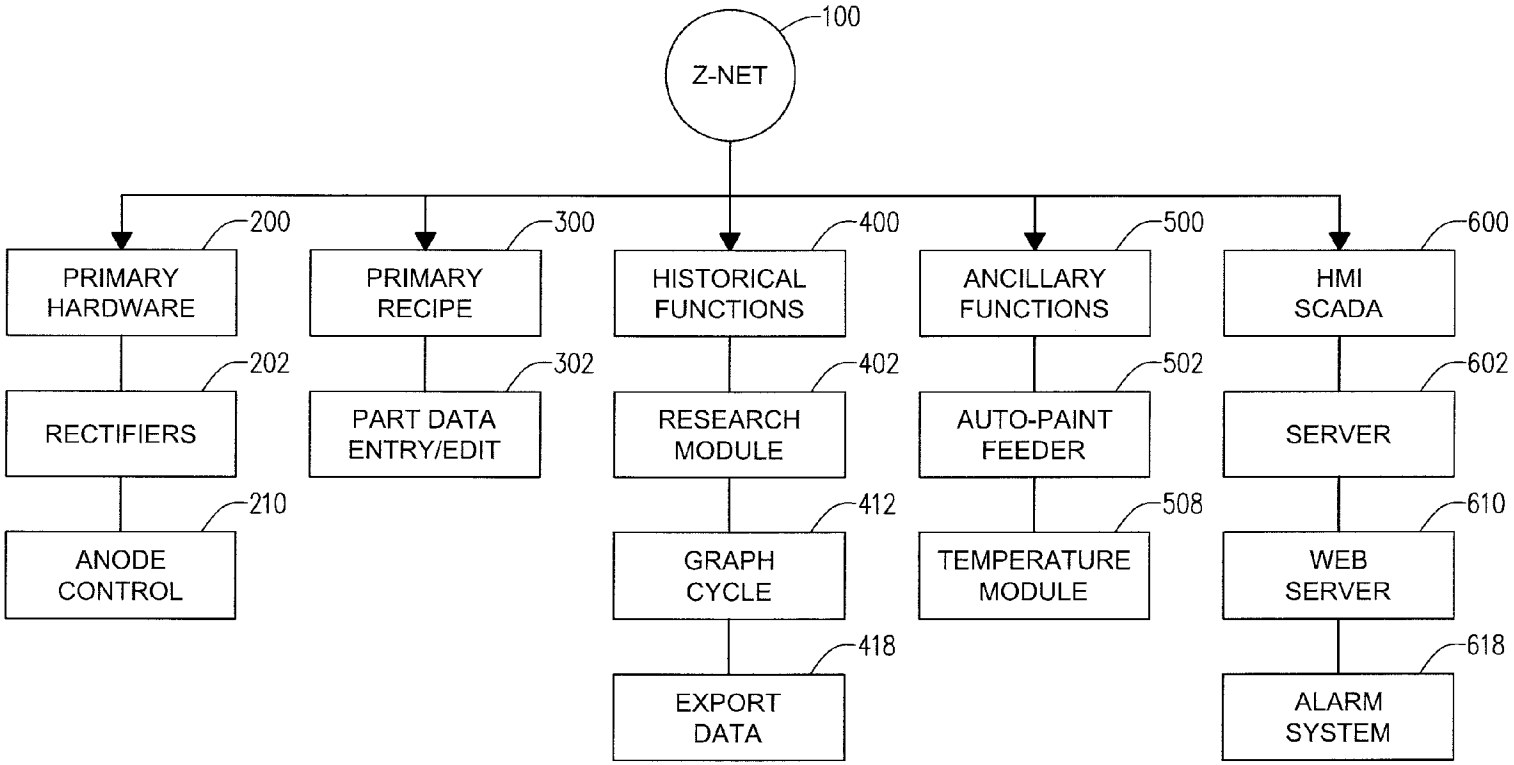
FIG. 5 is a flow chart illustrating the major functions of a control algorithm in accordance with an embodiment of the current invention.
Figure 5:
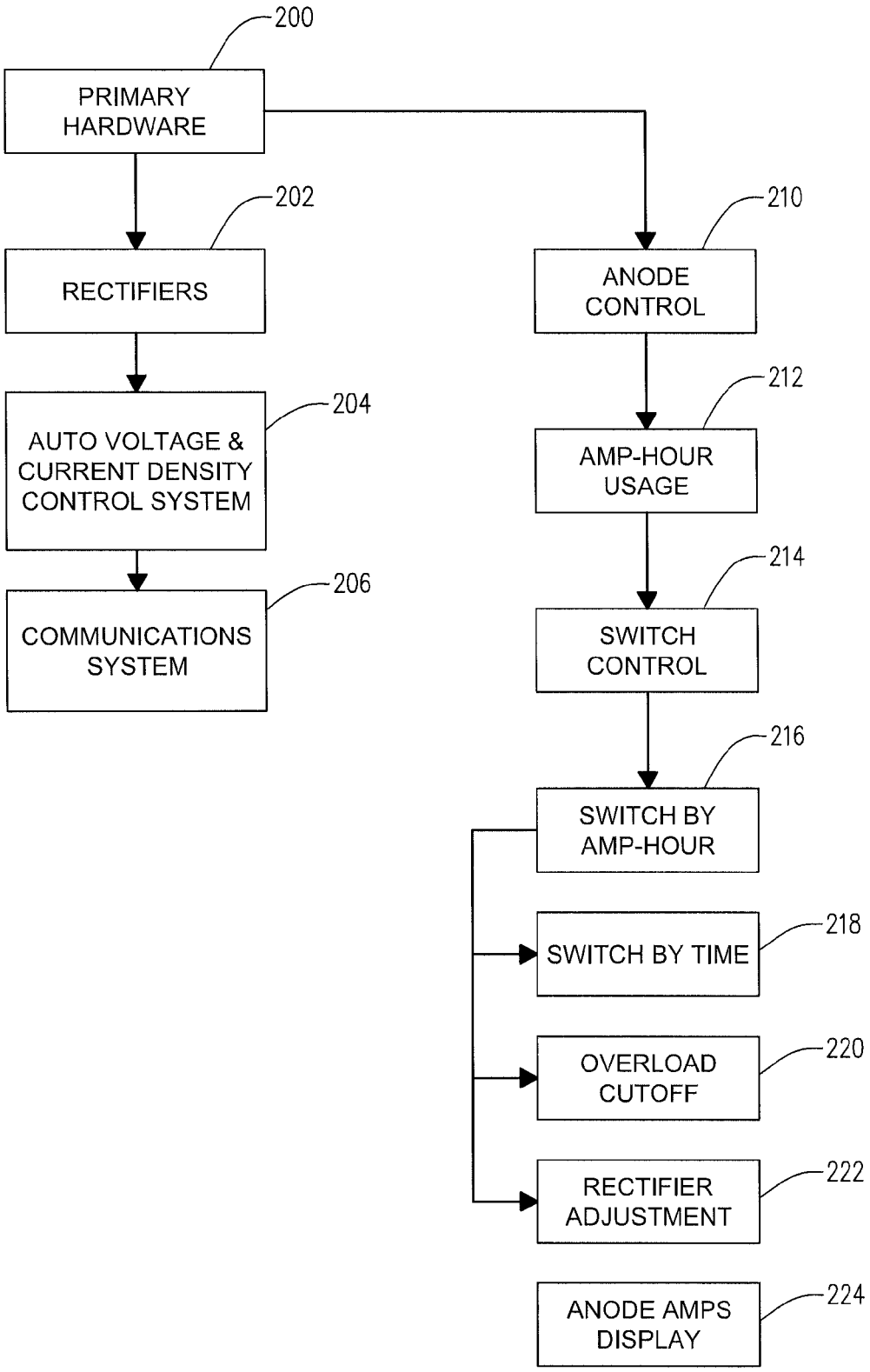

Turning now to FIG. 5, a flow chart of the operation of the control algorithm 100 is illustrated. The control algorithm generally has five main functions; primary hardware control 200, primary recipe control 300, historical functions 400, ancillary functions 500 and the human machine interface 600, referred to as HMI SCADA.

As can be better seen from FIG. 6, primary hardware control 200 comprises primarily rectifier control 202 and anode control 210. The rectifier control module 202 provides control of one or more rectifiers. Generally, at least two rectifiers will be used in parallel or backup configuration; however, for a large number of anodes it may be desirable to have two or more sets of rectifiers associated with two or more groups of anodes with each set comprising two rectifiers in backup configuration. Control algorithm 100 adjusts the rectifier output by an auto voltage and current density control system or module 204. The adjustments to the rectifier output can be based on the size of the workpiece and the specifics of the relevant recipe to be used. Additionally, the communication system enables communication between devices such as by using a serial communications protocol (for example, Modbus) to provide transmission control protocol communication to all hardware.

Anode control module 210 provides human machine interaction for direct control of coating of the workpiece. Anode control module 210 monitors lifetime amp-hour usage for each anode for maintenance purposes (block 212). Additionally, during each electrodeposition process run, the anode control module 210 provides switch control based on monitored anode status and time and amp-hour usage of each anode (block 214). Accordingly, anode control module 210 allows recipe switching of the anodes between on-mode and off-mode based on amp-hour usage (block 216), time usage (block 218) and allows for switching of the anodes based on possible overload or underperformance of an anode (block 220). Also, if an anode overload is detected (block 222), the rectifier can be adjusted through rectifier control module 202. Anode status or anode amps can be displayed to allow for human monitoring and adjustments of the anodes (block 224). The display of anode status can be updated frequently with updates typically occurring about every second. More generally, the updates can occur every 2 seconds or less and can be every 1 second or less. Often the updates will be in the range of from every 0.5 seconds to 2 seconds.

Figure 7:
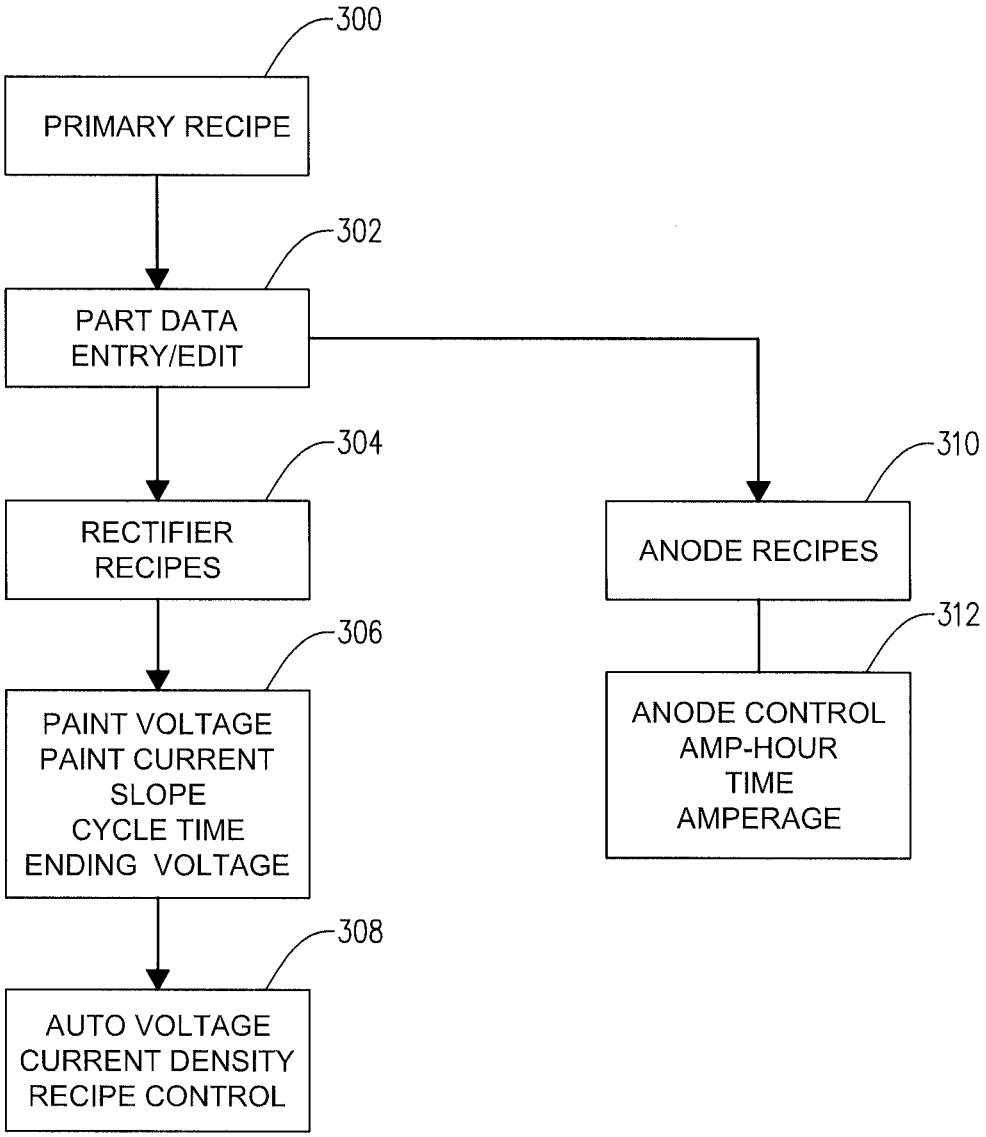
FIG. 7 is a flow chart illustrating in greater detail the primary recipe function of the embodiment illustrated in FIG. 5.

Turning now to FIG. 7, the primary recipe function control 300 of algorithm 100 is shown in greater detail. The recipe provides the instructions for running the electrodeposition process based on the type and size of workpiece and the coating material. The data specifying the part and recipe is entered into the process control unit (block 302). The recipe can be one available in digital memory accessible to the process control unit or can be manually entered through the human machine interface. Further the operator can edit the recipe available from memory if needed through a human machine interface. The recipe provides instructions for control of the rectifiers (rectifier recipes 304) and for control of the anodes (anode recipes 310). The standard rectifier recipe will provide instruction for the coating or paint cycle (block 306). The coating instructions can include voltage, amperage, cycle times, ramp voltage and time, and ending hold voltage. Additionally, the rectifier recipe can provide for auto voltage current density recipe control (block 308). This control provides for algorithm 100 to sample amperage in the coating bath and calculate square footage in the tank of the coating bath. The resulting current density is used to compensate for non-linear coating deposition rates and will override the standard instructions of the recipe. Non-linear coating deposition rates as used herein generally mean coating maldistributions where one or more areas of the workpiece surface are receiving coating material either faster or slower than in accordance with the recipe and, hence, either faster or slower than other areas of the workpiece surface. The anode recipes 310 provide instructions for the control of the anodes so that on-mode and off-mode adjustments can be made for each anode in accordance with amp-hours, time or amperage set points (block 312).

Figure 8:
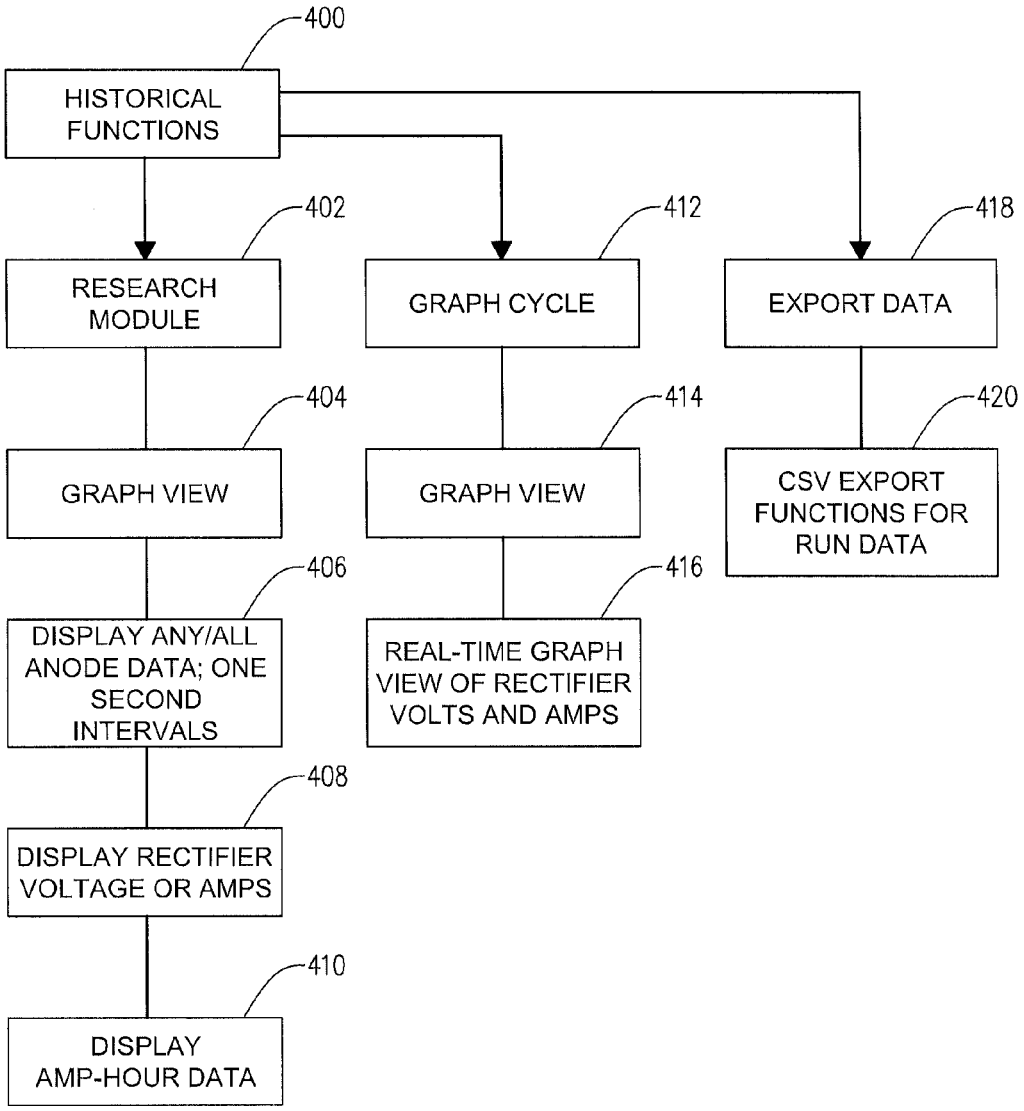
FIG. 8 is a flow chart illustrating in greater detail the historical function of the embodiment illustrated in FIG. 5.
Figure 5:
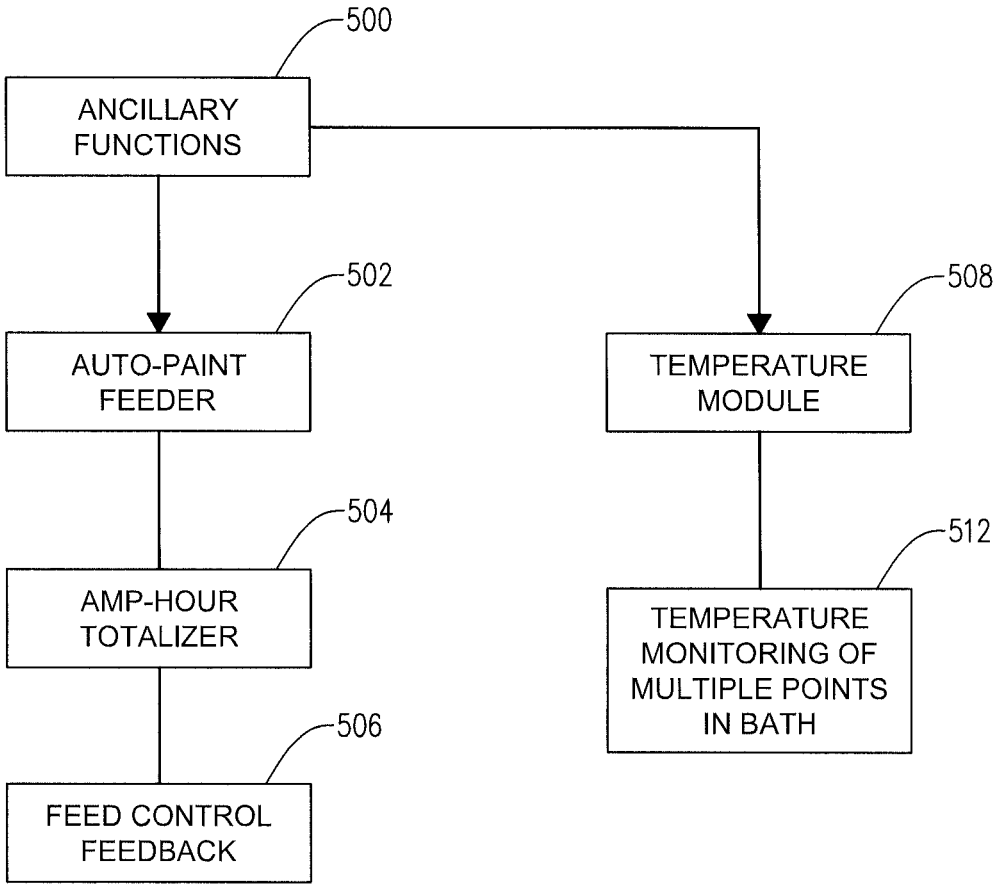

Turning now to FIG. 8, the historical function 400 of algorithm 100 is shown in greater detail. The historical function provides for the recording and recall of any electrodeposition process run data (block 402). The historical function provides for both data display and graphic display (block 404) of the run data. The run data can include anode performance 406, rectifier performance 408 and amp-hour run data 410, and can include temperatures during the electrodepositing process. Anode performance 406 can include the display of any or all anode data in broken down in time intervals, such as one second intervals. Rectifier performance 408 provides for the display of rectifier voltage or amps and can be broken down in time intervals. The amp-hour run data 410 provides for the display of amp-hour data for the total process and individual or groups of anodes. Additionally, graph cycle 412, 414 and 416 is provided, which can display a real-time graphical view of the rectifier volts and amps during the electrodeposition process. Finally, the historical function 400 provides for the export of data 418. The data export 418 can be a full or partial export of run data for use by other programs. Generally, the data export will be in a comma-separated values (CSV) file 420; that is, in a file with tabular data in plain text form.

Turning now to FIG. 9, the ancillary functions 500 of algorithm 100 is shown in greater detail. Ancillary functions 500 can include an auto-paint feeder function 502 and temperature module 508. Auto paint function 502 maintains paint or coating material consistency in the coating bath tank by feeding the necessary chemicals into the coating bath. Generally, auto tank function 502 will feed the necessary chemicals into the coating bath based on total amp-hours of the electrodeposition process run time and/or square footage of the workpiece surface. Thus, the control algorithm 100 can have an amp-hour totalizer 504 to track the total amp-hours of run time and quantify chemical uses by amp-hour of run time. Algorithm 100 can control the feed of the chemicals to the bath by controlling feed pumps 506. Typically, such feed control will be based on amp-hours, square footage of the workpiece surface and the feed rate as indicated by stroke sensors connected to the pumps. Temperature module 508 allows for monitoring of the electrodeposition process temperature. For example, by thermocouples connected to different points in the coating bath, the temperature module 508 can monitor up to 64 data points of temperature readings (see block 512). This temperature data can be fed to the human machine interface for display to the operator, thus allowing for process adjustment by the operator, and can be fed to the other functions, such as the primary recipe function, for automatic adjustment of the process by control algorithm 100.

Figure 10:
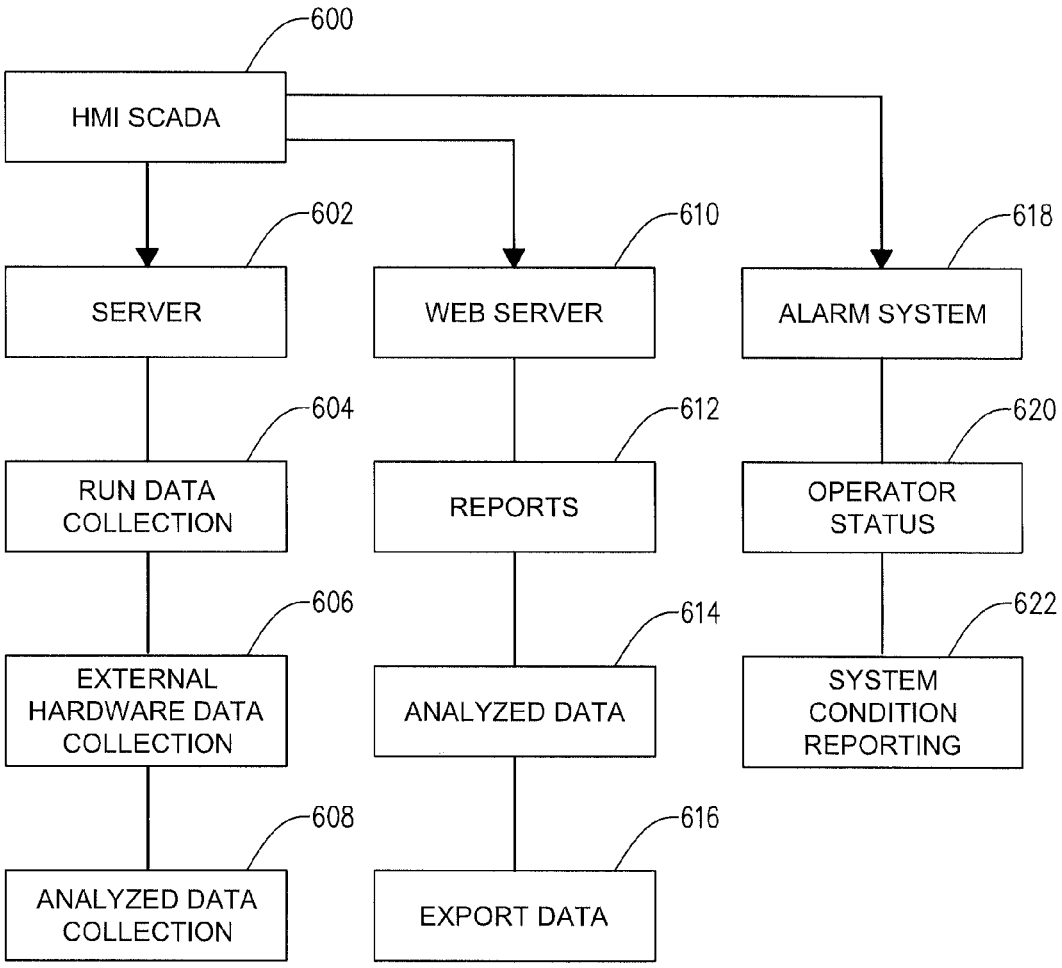
FIG. 10 is a flow chart illustrating in greater detail the human machine interaction functions of the embodiment illustrated in FIG. 5.

Turning now to FIG. 10, the human machine interaction functions (HMI) functions 600 of algorithm 100 is shown in greater detail. The HMI functions 600 controls the human and machine interaction and allows supervisory control by the operator and data acquisition control by the operator. The HMI functions 600 interact with the other functions and include a server 602 to serve as the main repository of data obtained by the historical function 400 and analysis of such data. For example, server 602 stores run data collection 604, that is stores each process runs' data and connections in one-second increments; stores external hardware data 606; that is data collected from systems external to the coating bath; and stores analyzed data 608, that is stores compilations of data and other data analysis for further analysis and reporting purposes.

Additionally, the HMI functions 600 can provide for web-based server access 610 so that there is remote access to data, analysis and reports stored on the server (block 602). The web-based server access 610 can include HTML reports 612, HTML run data graphs and composite data 614 and export file generation 616 with download connector.

Also, the HML functions 600 can include an alarm system 618, which interacts with the process monitoring functions. The alarm system can include a visual display of all critical systems across multiple screens to provide a constant status update for the operator (block 620) and can include a critical alarm, visual and/or auditory, to alert the operator to critical conditions; thus, providing a system condition reporting (block 622).

The above method and algorithm has application and can be used advantageously in most electrodeposition processes. One embodiment where it can be used very advantageously is when both the interior and exterior of a workpiece is to be coated by electrodeposition. For example, in the electrodeposition of pipes, it can be difficult to suitably deposit a uniform coating on both the exterior and interior of the pipe, especially for longer lengths of pipes.

Figure 11:
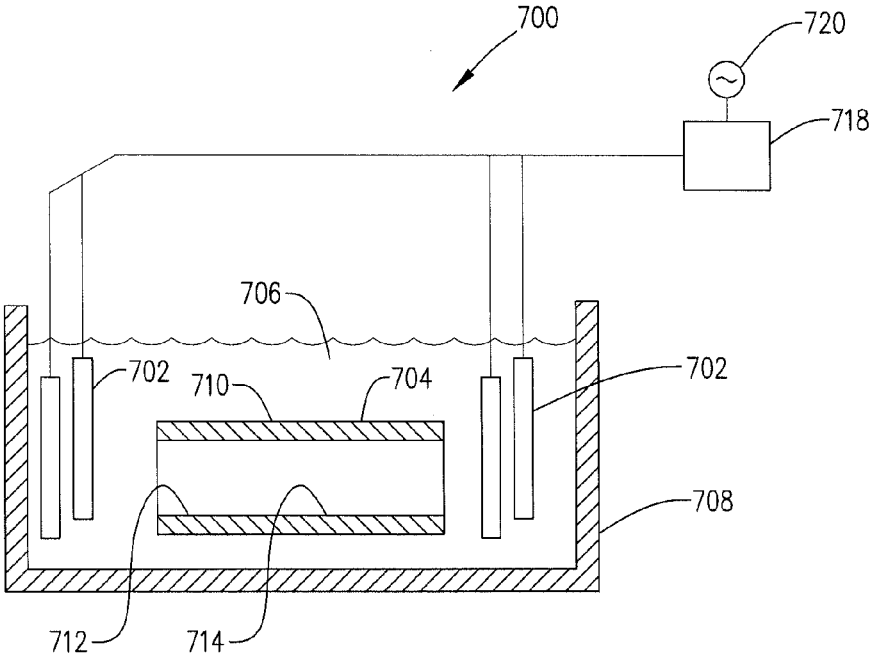
FIG. 11 PRIOR ART
FIG. 11 is a schematic illustration with partial cut-away of a prior art apparatus for coating a pipe by electrodeposition.

Traditionally, such pipes have been coated in accordance with the electrodeposition apparatus 700 depicted in FIG. 11. Prior art electrodeposition apparatus 700 have had a plurality of anodes 702 positioned around a pipe 704. Pipe 704 served as the cathode. Pipe 704 and anodes 702 were positioned in a coating bath 706 contained in a tank 708. Anodes 702 were connected to a rectifier 718 and power source 720. Pipe 704 was connected to rectifier 718 or otherwise grounded (connection not shown). In operation, the anodes 702 were spaced about pipe 704 sufficiently to achieve a relative uniform coating on the exterior surface 710 of pipe 704, as long as none of the anodes underperform; however, the interior surface 712 of pipe 704 was more isolated than the exterior surface 710 from anodes 702. Thus, interior surface 712 did not receive a uniform coating even if there were no underperforming anodes. In fact for longer pipes, the center 714 of interior surface 712 received little or even no coating of the coating material during the electrodeposition process.

Figure 12:
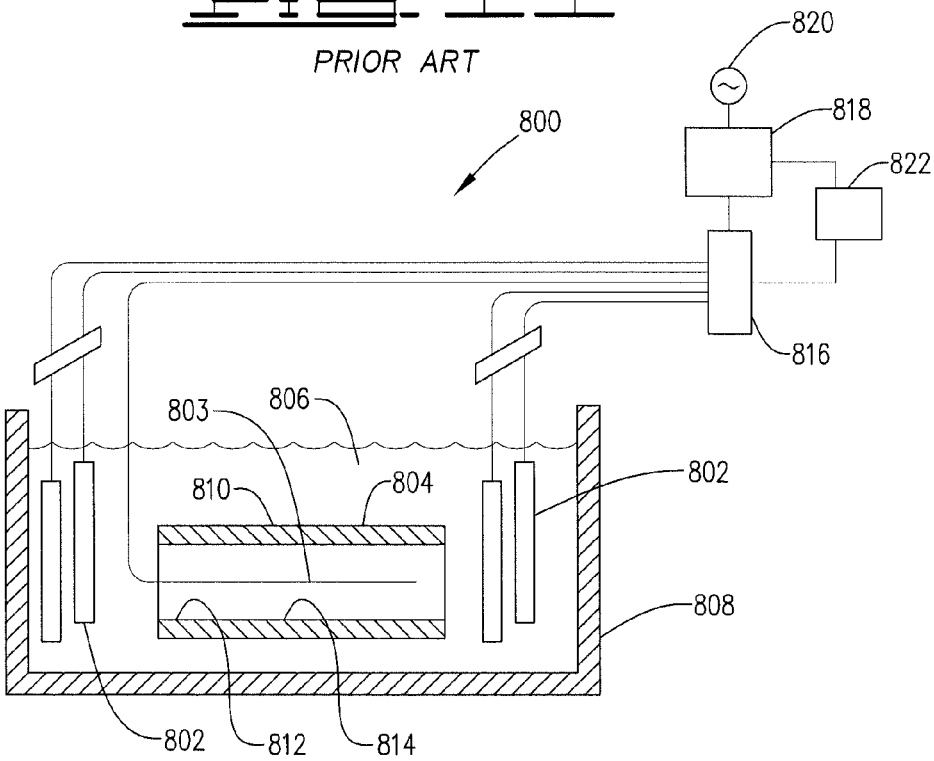
FIG. 12 is a schematic illustration with partial cut-away of an apparatus for coating a pipe in accordance with one embodiment of the current invention.

Turning now to FIG. 12, an electrodeposition apparatus 800 in accordance with an embodiment of the invention is illustrated. Electrodeposition apparatus 800 has a plurality of exterior anodes 802 positioned around a pipe 804 and interior anode 803 runs through the center of pipe 804. Pipe 804 serves as the cathode. Pipe 804, exterior anodes 802 and interior anode 803 are positioned in a coating bath 806 contained in a tank 808. Exterior anodes 802 and interior anode 803 are connected to switching system 816, which is connected to rectifier 818, which in turn is connected to power source 820. Switching system 816 and rectifier 818 are operationally connected to process control unit 822, which controls switching system 816 and rectifier 818 as previously described. Pipe 804 is connected to rectifier 818 or grounded (connection not shown). In operation, exterior anodes 802 can be spaced about pipe 804 sufficiently to achieve a relative uniform coating on the exterior surface 810 of pipe 804. Additionally, interior surface 812 of pipe 804 is not isolated from the anodes because of interior anode 803 running longitudinally through the center of pipe 804. Other embodiments for placing an anode inside pipe 804 will be apparent from this disclosure and are within the scope of the present invention.

Also, underperformance of anodes can be compensated for by process control unit 822. In one embodiment, anodes 802 and anode 803 are operated simultaneously; that is both are in the on-mode continuously during the electrodeposition process. This embodiment results in a more uniform coating on both exterior surface 810 and interior surface 812 than in the conventional process illustrated in FIG. 11; however, it can still result in inconsistent coating of the pipe due to exterior anodes 802 and interior anode 803 not being an equal distance from the same amount of surface area of pipe 804. In another embodiment, process control unit 822 utilizes a recipe, which operates exterior anodes 802 separately from interior anodes 803; that is, exterior anodes 802 and interior anode 803 are not both in the on-mode at the same time during the electrodeposition process. Moreover, the algorithm run by process control unit 822 compensates for underperformance of exterior anodes 802 and interior anodes 803, which are detected during the electrodeposition process. Thus, this embodiment produces a uniform coating of material on both exterior surface 810 and interior surface 812 even at center point 814 of interior surface 812.

Figure 13:
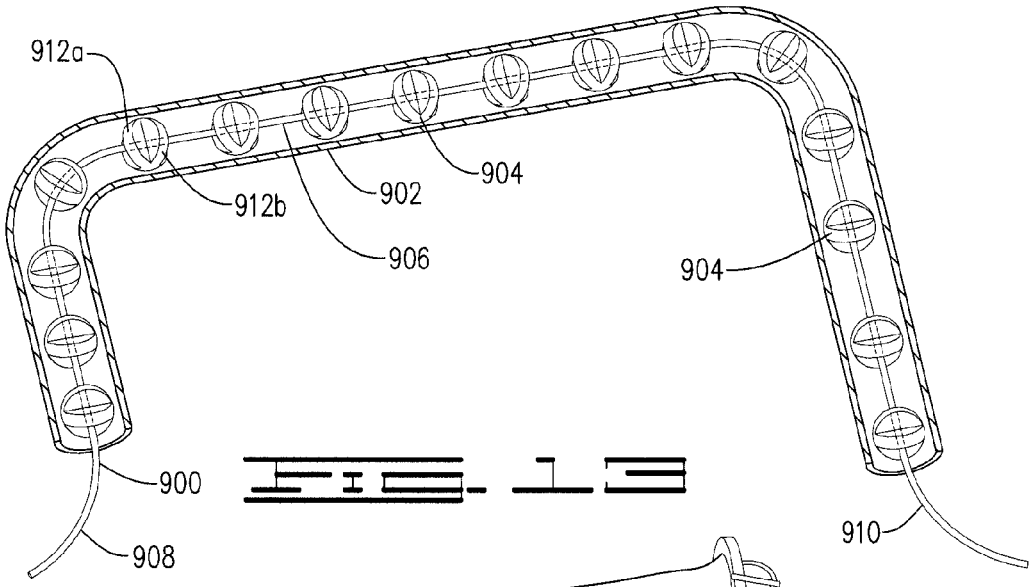
FIG. 13 is an illustration of an electrode having a wire and insulating positioner in accordance with an embodiment of the invention. The electrode is shown positioned in the outline of a pipe.

The electrodeposition apparatus described above with respect to FIG. 12 works well; however, for longer pipes or other workpieces, the interior anode running through the pipe can sag and at best create uneven interior coating by not being positioned along the central axis, that is the interior anode sags placing at least a portion of it closer to one side of the interior surface than to the other. In worse cases, the interior anode will sag sufficiently to contact the interior surface, thus, shorting out the anode. Additionally, for pipes or other workpieces with turns or bends, a flexible interior anode is needed; however, this creates additional chances that the interior anode will sag or will be off-center at the bends. Turning now to FIG. 13 an electrode suitable for use in pipes or other workpieces, for resisting sagging and for maintaining the electrode in the center of the pipe or workpiece is illustrated. FIG. 13 shows the electrode 900 of the current invention positioned in a pipe 902. Electrode 900 comprises a conductive member 906 and a plurality of insulating positioners 904. Conductive member 906 is illustrated and will be referred to herein as a wire but it should be understood that it can have other embodiments such as a conductive pipe or rod. Conductive wire 906 has a length extending from a first end 908 to a second end 910. The length should be long enough to extend conductive wire 906 through pipe 902 and, preferably should be long enough to provide for being tensioned by a tensioning device such as that described below with respect to FIGS. 14 and 15.

Figure 16:
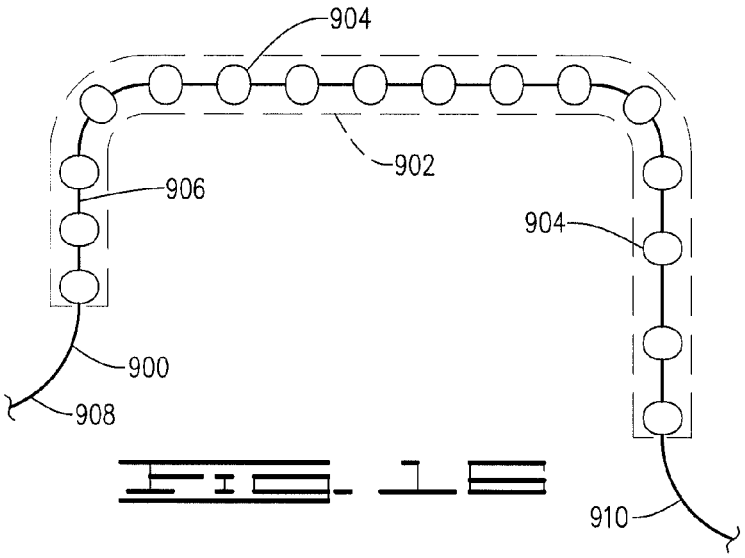
FIG. 16 is an illustration similar to FIG. 13 but showing another embodiment of the insulating positioner

The plurality of insulating positioners 904 are connected to conductive wire 906 and spaced along the length of conductive wire 906. The insulating positioners 904 illustrated in FIG. 13 are each formed from two perpendicular insulating disks 912*a* and 912*b*. Insulating disk 912*a* and 912*b* each disk have a diameter approximately equal to the internal diameter of the pipe. Additionally, conductive wire 906 extends from the centers of adjacent insulating positioners. Thus, conductive wire 906 is held approximately along the centerline of pipe 902. Other shapes of insulating positioners 904 can be used. Thus, for example insulating positioners 904 can be in the form of a ball having a diameter approximately equal to the internal diameter of pipe 902 with each insulating positioner 904 connected to conductive wire 906 such that conductive wire 906 extends from the centers of adjacent insulating positioners 904 (see FIG. 16). Other shapes are also useable as long as the conductive wire is held along the centerline of the interior pipe so that it is equal distance from the interior circumference of the interior surface of pipe or workpiece. Generally, this will mean that the breadth of each insulating positioner is approximately equal to the internal diameter of pipe. The breadth being perpendicular to the length of the wire at the point on which the insulating positioner is attached. By "approximately equal to the internal diameter of the pipe" it is meant that the diameter or breadth is equal to or less than the interior diameter of the pipe but sufficient to ensure that the conductive wire is held substantially at the centerline and does not move laterally to the centerline so that during the electrodeposition process there will be uniform depositing of coating material over the interior surface of the pipe or workpiece.

It is preferred that electrode 900 is connected to a switch and a process control unit running an algorithm as described above such that the electrode can be switched between an on-mode, in which electrical current is passed through the electrode, and an off-mode, in which no electrical current is passed through the electrode. Thus, electrode 900 can be in the on-mode at a separate time in the process from when the electrodes exterior to the pipe 902 are in the on-mode.

Figure 14:
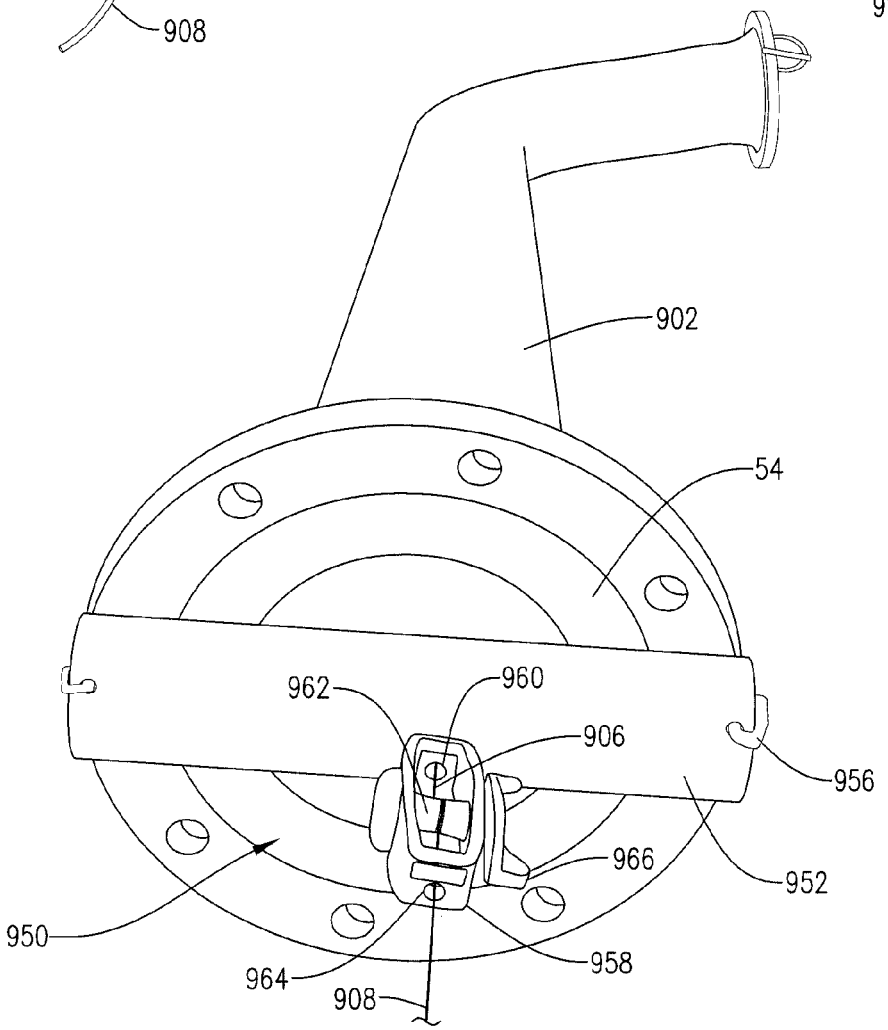
FIG. 14 is an illustration of a tension adjuster for use with the electrode of the embodiment illustrated in FIG. 13.
Figure 15:
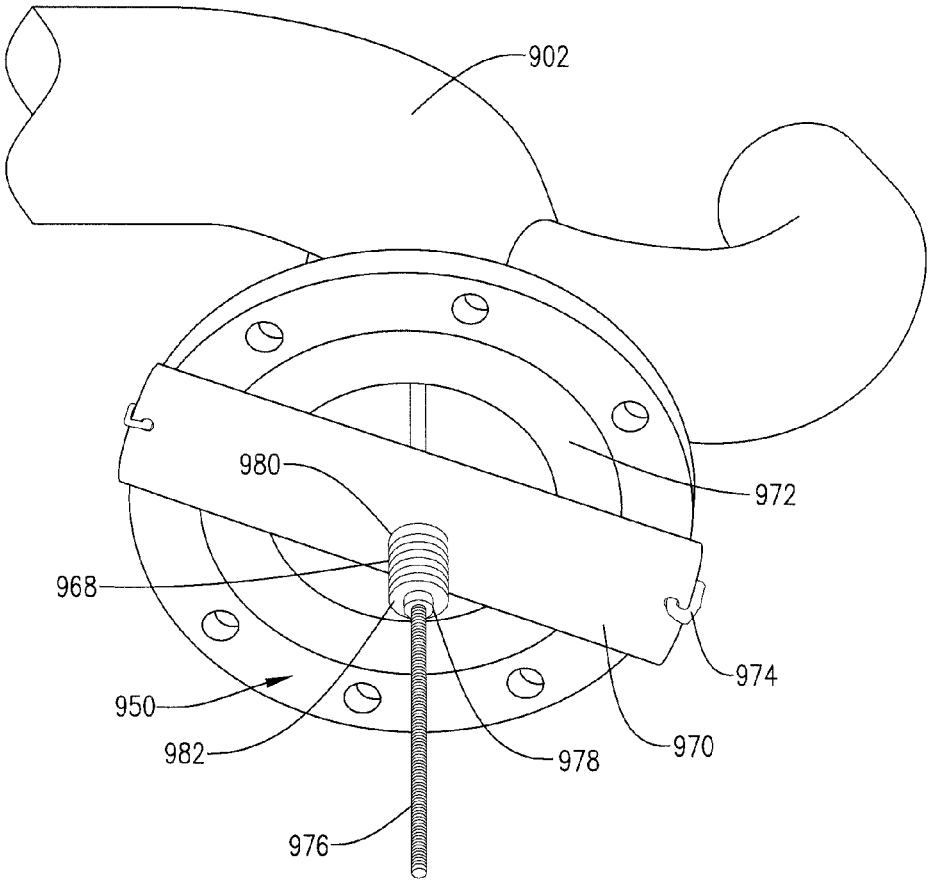
FIG. 15 is an illustration of a tension spring for use with the electrode of the embodiment illustrated in FIG. 13.

Turning now to FIGS. 14 and 15, a tensioning device for use with electrode 900 is illustrated. Generally, electrode 900 will be placed under tension in order to insure that it stays in place and to prevent sagging between the insulating positioners. In FIG. 14, a tensioning device 950 is illustrated. Tensioning device 950 has bar 952 which is positioned across a first end 954 of pipe 902 and held in place by fasteners 956. Conductive wire 906 extends through bar 952 and threads into tension adjuster 958 via first aperture 960. Conductive wire 906 is attached through roller 962 of tension adjuster 958 with the first end 908 of conductive wire 906 extending out through second aperture 964. Roller 962 is connected to ratcheted handle 966 such that by turning ratcheted handle 966, roller 962 is turned and conductive wire 906 is wound about roller 962. Thus, by turning ratcheted handle 966 the tension on wire 906 and hence electrode 900 is increased.

In FIG. 15, a tension spring 968 for use with tensioning device 950 is illustrated. A bar 970 is positioned across a second end 972 of pipe 902 and held in place by fasteners 974. Conductive wire 906 is attached to rod 976, which extends through bar 970. Rod 976 has tension spring 968 mounted on it. Tension spring 968 is held in place by nut 978 and bar 970. Additionally, washers 980 and 982 can be used to help hold tension spring 968 in place. Thus, when the tension on electrode 900 is increased by tensioning device 950, tension spring 968 is compressed preventing damage to electrode 900 by over-tensioning and aiding in maintaining a constant tension on electrode 900.

In operation, electrode 900 is positioned to extend through the interior of pipe 902 and attached to tensioning device 958 and rod 976. The tension on electrode 900 is then adjusted by turning ratcheted handle 966 to ensure that conductive wire 906 does not sag between insulating positioners 904. Next first end 908 of conductive wire 906 is connected to a switching system as described above. Pipe 902 is then lowered into a coating bath to undergo an electrodeposition process. During the electrodeposition process and in accordance with the appropriate recipe or manual instructions, electrode 900 is switched between the on-mode and off-mode.

It will be seen that the method of the current invention is well adapted to carry out the ends and advantages mentioned as well as those inherent therein. While the presently preferred embodiment of the invention has been shown for the purposes of this disclosure, numerous changes in the arrangement and construction of parts may be made by those skilled in the art. All such changes are encompassed within the scope and spirit of the dependent claims.

What is claimed is:

1. An electrode for use in the interior of a pipe to be coated with a coating material in an electrodeposition process, the electrode comprising:

a conductive member having a length;

a plurality of insulating positioners connected to the conductive member and spaced along the length of the conductive member so as to not be in direct contact with each other and to leave a portion of the conductive member between adjacent insulating positioners with no insulating positioner, wherein each insulating positioner has a breadth perpendicular to the length of the conductive member at the position it is connected thereto, and wherein the pipe has a centerline and the breadth is equal to or less than the interior diameter of the pipe but sufficient to ensure that the conductive member is held at the centerline and does not move laterally to the centerline so that during the electrodeposition process there is uniform depositing of the coating material over the interior surface of the pipe, wherein each insulating positioner is formed from two perpendicular insulating disks, each disk having a diameter approximately equal to the internal diameter of the pipe and each the insulating positioner is connected to the conductive member such that the conductive member extends from the centers of adjacent insulating positioners.

2. An electrode for use in the interior of a pipe to be coated with a coating material in an electrodeposition process, the electrode comprising:

a conductive member having a length;

a plurality of insulating positioners connected to the conductive member and spaced along the length of the conductive member, wherein each insulating positioner has a breadth perpendicular to the length of the conductive member at the position it is connected thereto, and wherein the pipe has a centerline and the breadth is equal to or less than the interior diameter of the pipe but sufficient to ensure that the conductive member is held at the centerline and so that the insulating positioner does not move laterally to the centerline so that during the electrodeposition process there is uniform depositing of the coating material over the interior surface of the pipe; and a tension adjuster configured to place the conductive member under tension in order to insure that it stays in place and to prevent sagging between the insulating positioners.

3. The electrode of claim 2, wherein the tension adjuster comprises a roller and a ratcheted handle such that the conductive member is attached to the roller and movement of the ratcheted handle turns the roller to increase tension on the conductive member.

4. The electrode of claim 3, further comprising a tension spring configured to compress when tension on the conductive member is increased thus preventing damage to the electrode.

5. The electrode of claim 4, wherein adjacent insulating positioners are not in direct contact with each other.

6. The electrode of claim 5, wherein the insulating positioners are spaced along the length of the conductive member so as to leave a portion of the conductive member between adjacent insulating positioners with no insulating positioner.

7. The electrode of claim 6, wherein each insulating positioner is formed from two perpendicular insulating disks, each disk having a diameter approximately equal to the internal diameter of the pipe and each insulating positioner is connected to the conductive member such that the conductive member extends from the centers of adjacent insulating positioners.

8. The electrode of claim 6, wherein each the insulating positioner is in the form of a ball having a diameter approximately equal to the internal diameter of the pipe and each insulating positioner is connected to the conductive member such that the conductive member extends from the centers of adjacent insulating positioners.

* * * * *